US009044686B2

(12) United States Patent
Aguila

(10) Patent No.: US 9,044,686 B2
(45) Date of Patent: Jun. 2, 2015

(54) PINATA DEVICE

(71) Applicant: Rick Aguila, Miami Springs, FL (US)

(72) Inventor: Rick Aguila, Miami Springs, FL (US)

( * ) Notice: Subject to any disclaimer, the term of this patent is extended or adjusted under 35 U.S.C. 154(b) by 301 days.

(21) Appl. No.: 13/654,067

(22) Filed: Oct. 17, 2012

(65) Prior Publication Data

US 2013/0092138 A1 Apr. 18, 2013

Related U.S. Application Data

(60) Provisional application No. 61/548,017, filed on Oct. 17, 2011.

(51) Int. Cl.
*A63H 37/00* (2006.01)
*F41B 7/08* (2006.01)

(52) U.S. Cl.
CPC . *A63H 37/00* (2013.01); *F41B 7/08* (2013.01)

(58) Field of Classification Search
CPC ..... A63H 37/00; F41B 7/08
USPC ..... 124/1, 16, 37; 446/4, 5, 310, 473, 475, 446/486
See application file for complete search history.

(56) References Cited

U.S. PATENT DOCUMENTS

| | | | | | |
|---|---|---|---|---|---|
| 221,694 | A * | 11/1879 | Mulholland | 124/16 |
| 2,001,449 | A * | 5/1935 | Bergstrom | 124/16 |
| 3,191,342 | A * | 6/1965 | Chalmers | 446/231 |
| 3,455,287 | A * | 7/1969 | Oddo | 124/16 |
| 4,164,928 | A * | 8/1979 | Meares | 124/16 |
| 4,832,337 | A * | 5/1989 | Estrada | 273/440 |
| 5,015,211 | A * | 5/1991 | Reveen | 446/475 |
| 5,120,263 | A * | 6/1992 | Ierfino et al. | 446/486 |
| 5,242,308 | A * | 9/1993 | Estrada | 434/365 |
| 5,562,328 | A * | 10/1996 | Schottenfeld | 312/35 |
| 5,597,160 | A * | 1/1997 | Mims | 124/16 |
| 5,664,551 | A * | 9/1997 | Spector | 124/16 |
| 6,129,608 | A * | 10/2000 | Prichard et al. | 446/475 |
| 6,220,479 | B1 * | 4/2001 | Fishman | 221/24 |
| 6,450,160 | B1 * | 9/2002 | Fu et al. | 124/57 |
| 6,572,435 | B1 * | 6/2003 | Wong | 446/475 |
| 6,669,530 | B2 * | 12/2003 | Du | 446/475 |
| 7,008,289 | B2 * | 3/2006 | Norman | 446/310 |
| 7,028,682 | B1 * | 4/2006 | Hansen | 124/16 |
| 7,350,477 | B1 * | 4/2008 | Tilford et al. | 118/13 |
| 7,442,106 | B1 * | 10/2008 | Menow et al. | 446/5 |
| 7,703,447 | B2 * | 4/2010 | Caveza | 124/16 |
| 8,469,011 | B2 * | 6/2013 | Mroczka et al. | 124/16 |
| 8,733,334 | B2 * | 5/2014 | Mroczka et al. | 124/16 |
| 2003/0143922 | A1 * | 7/2003 | Du | 446/475 |
| 2010/0180877 | A1 * | 7/2010 | Fielding, Jr. | 124/16 |

* cited by examiner

*Primary Examiner* — Melba Bumgarner
*Assistant Examiner* — Alexander Niconovich
(74) *Attorney, Agent, or Firm* — Robert M. Downey, P.A.

(57) ABSTRACT

A piñata device includes a main body housing an open-top container that may be filled with candy, toys, or other items. The open-top container is spring loaded using and arrangement of elastomeric bands and a locking mechanism which, when triggered, releases the open-top container, thereby causing the container to immediately accelerate towards an opening on the main body and launch the items outwards of the main body and onto the floor for collecting by the participants. In a preferred embodiment, the locking mechanism is triggered by hitting a target with a ball. After use, the container may be pushed or pulled back into a loaded position for reuse.

3 Claims, 9 Drawing Sheets

PINATA DEVICE

BACKGROUND OF THE INVENTION

This non-provisional patent application is based on provisional patent application Ser. No. 61/548,017 filed Oct. 17, 2011.

FIELD OF THE INVENTION

The present invention relates to children's party games and, more particularly, to a piñata device that launches items out of a main container when triggered.

DISCUSSION OF THE RELATED ART

A typical piñata includes a decorative body, generally made out of paper-mâché, filled with candy and toys that may be suspended from the ceiling and alternately struck by children with a stick until the body is broken and the candy and toys fall to the floor for children to collect. While piñata games of this nature have been a longstanding tradition in many cultures, there are drawbacks associated with typical piñatas. The manner in which the candy and toys fall to the floor produces a single pile of items for children to collect, which may result in only the more aggressive participants collecting all of the items, thereby leaving some children without any candy or toys. Furthermore, this disorganized approach can cause injury to children as they are forced to aggressively rush towards the pile and come into contact with other children should they hope to collect any candy or toys. Lastly, as piñatas are generally made out of paper-mâché, they are only suitable for one-time use.

In view of the shortcomings associated with traditional piñatas, there remains a need for a piñata device that is fun and safe for children, and which can be reused on multiple occasions.

OBJECTS AND ADVANTAGES OF THE INVENTION

Considering the foregoing, it is a primary object of the present invention to provide a piñata device that launches items such as candy and/or small toys outwards of a main body, in a scattered fashion, thereby allowing all participants to collect some of the items as the items land throughout an area of a room or yard.

It is a further object of the present invention to provide a piñata device that is reusable.

It is a further object of the present invention to provide a piñata device that is easy to use and minimizes the chance of injury by avoiding a converging rush of participants.

These and other objects and advantages of the present invention are more readily apparent with reference to the detailed description and accompanying drawings.

SUMMARY OF THE INVENTION

The present invention is directed to a piñata device that includes a main body housing an open-top container that may be filled with candy, toys, or other items. The open-top container, generally in the form of a bucket, is held in a loaded position against the force of one or more elastomeric bands by a trigger and locking mechanism which, when triggered, releases the open-top container, thereby causing the container to immediately accelerate towards an opening on the main body and launch the items within the container outwards from an open top of the main body and onto the floor for collecting by the participants. In a preferred embodiment, the locking trigger and mechanism is triggered by hitting a target with an object, such as a ball or bean bag. After use, the container can be pushed or pulled back into a loaded position for reuse.

BRIEF DESCRIPTION OF THE DRAWINGS

For a fuller understanding of the nature of the present invention, reference should be made to the following detailed description taken in conjunction with the accompanying drawings in which.

Like reference numerals refer to like referenced parts throughout the several views of the drawings.

DETAILED DESCRIPTION OF THE PREFERRED EMBODIMENT

Referring to the several views of the drawings, and initially FIGS. 1-6B, the piñata device of the present invention is shown in accordance with a first embodiment and is generally indicated as 10.

Figure 1:
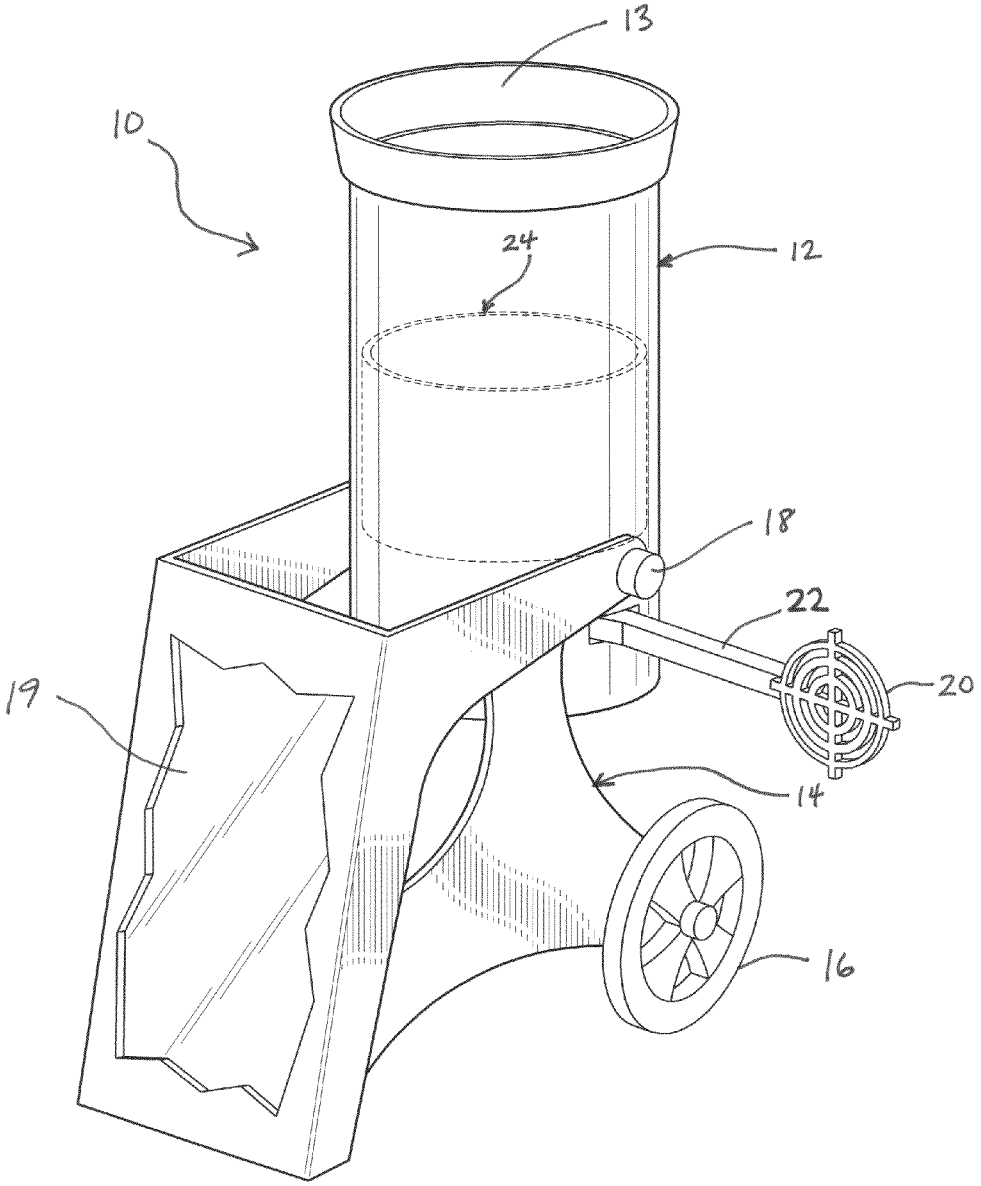
FIG. 1 is a front perspective view of the piñata device of the present invention, in accordance with a preferred embodiment thereof.
Figure 2:
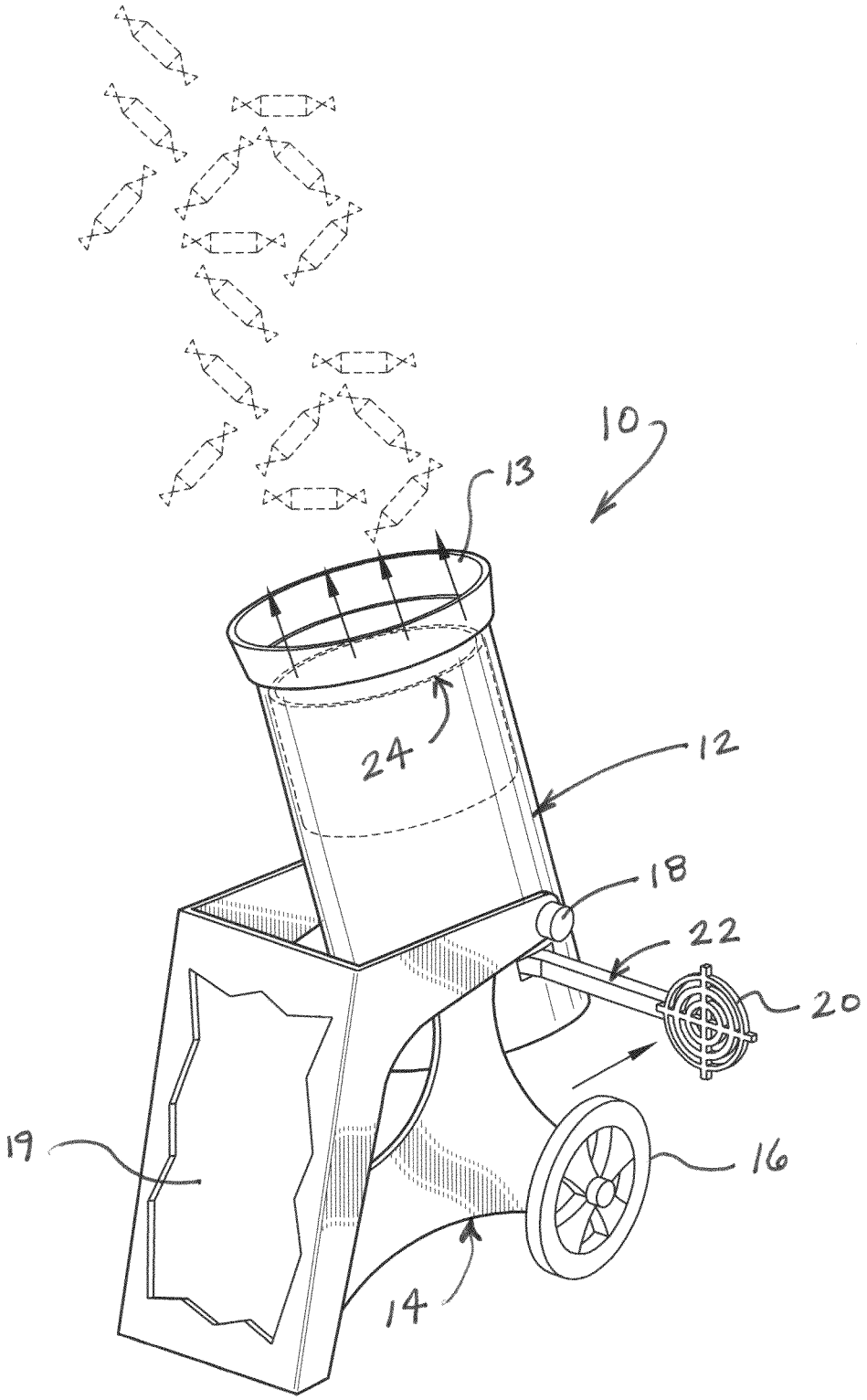
FIG. 2 is a front perspective view of the piñata device of FIG. 1 shown in operation, after actuating a trigger mechanism, and releasing candy or other items outwardly and upwardly through an open top of a main body of the device.

As seen in FIGS. 1 and 2, the piñata device 10 includes a main body 12 that has an open top 13 and a base opposite of the open top. The main body 12 is preferably cylindrical and, in accordance with the preferred embodiment, is in the form of a cannon barrel. The cylindrical main body 12 is pivotally attached on opposite sides to a support base 14 that has a pair of wheels 16 to facilitate easy transport and positioning of the piñata device. Adjustment knobs 18 at the opposite sides of the pivot connection of the main body to the base allow for adjusted fixed positioning of the main body at adjusted angular positions relative to the base. The knobs are rotated in one direction to loosen the pivotal connections so that the main body can be angled at the desired position. Once in the desired position, the knobs 18 are tightened in order to fix the main body in the desired adjusted position, relative to the base, so that the open top 13 of the main body is directed at the desired angle for launching candy and/or toys or other objects, as described hereinafter. The base includes a removable display panel or dry erase board 19 that allows for placement of customized messages for a party, such as "Happy Birthday Mary."

A trigger mechanism includes a trigger arm 22 that extends from a lower portion of the main body 12 to a distal end having a target 20 adjustably fitted thereto. An open top container 24 is movably supported within the hollow interior of the main body so that an open top 25 of the container 24 is positioned upwardly towards the open top 13 of the main body. In a preferred embodiment, the container 24 is generally in the form of a bucket and is specifically intended for holding individual pieces of candy, small toys and other party favors and/or novelty items to be distributed to attendees of a party, such as kids at a birthday party.

Referring to FIGS. 3-6B, a main shaft 30 is fixed to the bottom 26 of the container 24 and extends through the bottom of the main body 12, terminating at a distal end having a knob 32. In operation, the shaft 30 is pulled downwardly in relation to the main body 12, by grasping the knob 32, thereby pulling the container 24 downwardly within the interior of the main body 12 against the force of biasing members. In a preferred embodiment, the biasing members are in the form of one or more elastomeric bands 28 that extend through or connect to the container 24 with opposite ends of the elastomeric bands 28 fixed to the main body, near the open top 13. In a preferred embodiment, the elastomeric bands 28 include button heads 29 on the ends to facilitate attachment to the main body. Specifically, openings through the wall of the main body, near the open top 13, are sized to allow passage of the elastomeric bands 28 therethrough, but not the button heads 29, so that the elastomeric bands can be stretched and tensioned while the ends of the elastomeric bands having the button heads 29 are held secure to the main body. When the shaft 30 is pulled back, the elastomeric bands 28 are stretched and placed under tension, thereby exerting a force on the container that urges the container upwardly toward the open top 13. The shaft 30 is held in place by a trigger and locking mechanism. Specifically, in a preferred embodiment, the shaft is provided with a series of notches 31*a*, 31*b*, and 31*c* defining adjusted locked and loaded positions. Each of these notches is sized for locking receipt of a proximal end 23 of the trigger arm 22 therein to hold the shaft 30 at the fixed, loaded position. Notch 31*a* defines the minimal tension position, wherein the elastomeric bands 28 are pulled and stretched to a minimal tension that will launch candy and other items in the container the shortest of three adjusted distances. Notch 31*b* is a medium loaded position for launching the candy and other items in the container a medium distance, while notch 31*c* defines the maximum loaded position, wherein the shaft 30 is pulled back its maximum loaded distance with the elastomeric bands 28 stretched to the highest tension so that candy and other items in the container 24 are launched the maximum distance upon actuation of the trigger mechanism as described below.

Figure 3:
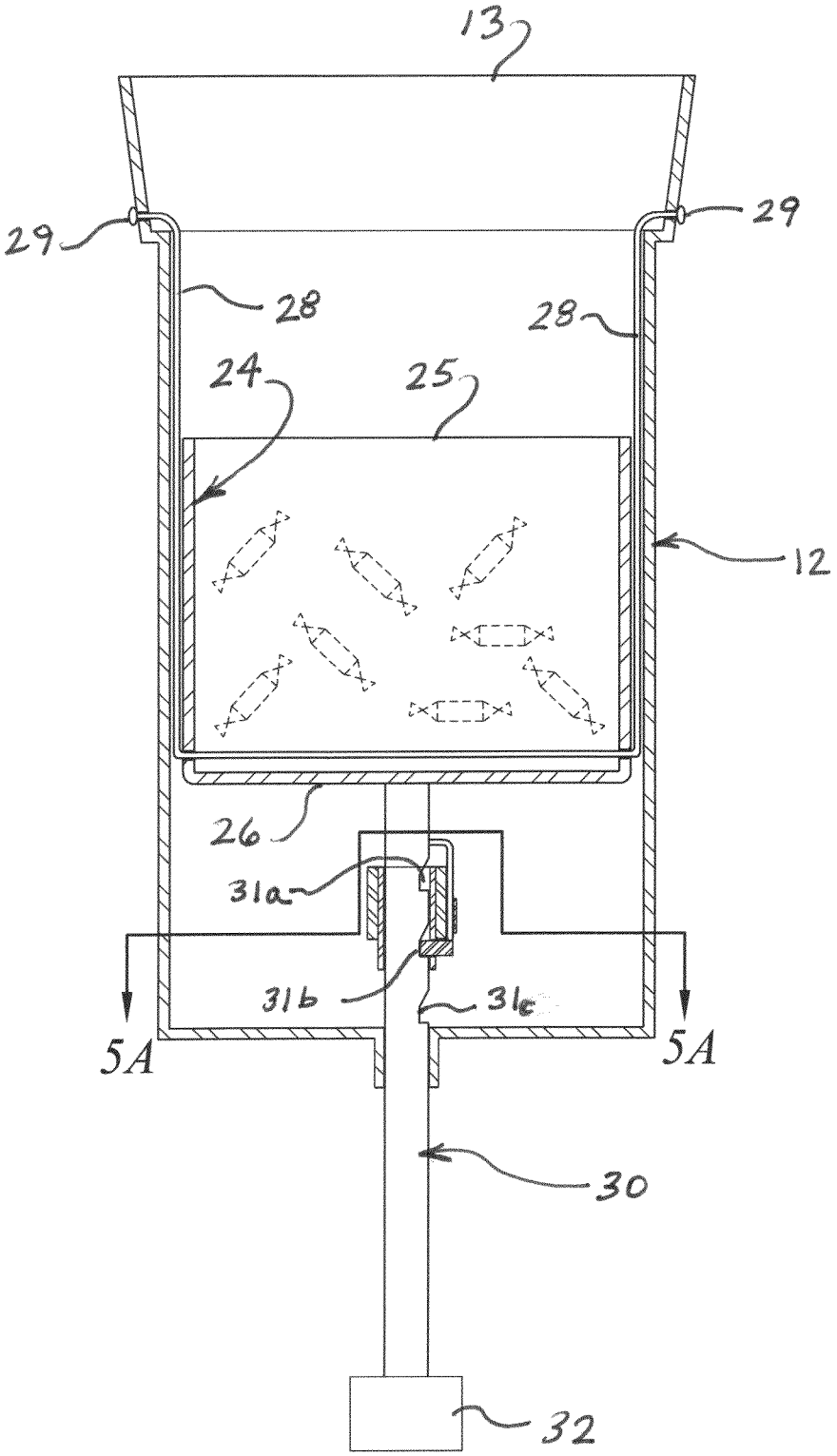
FIG. 3 is an isolated elevational view shown in partial cross-section, illustrating a candy holding container within the outer cylindrical main body of the device held in a locked position against the force of elastomeric bands, defining a loaded position prior to actuation of a trigger mechanism.
Figure 4:
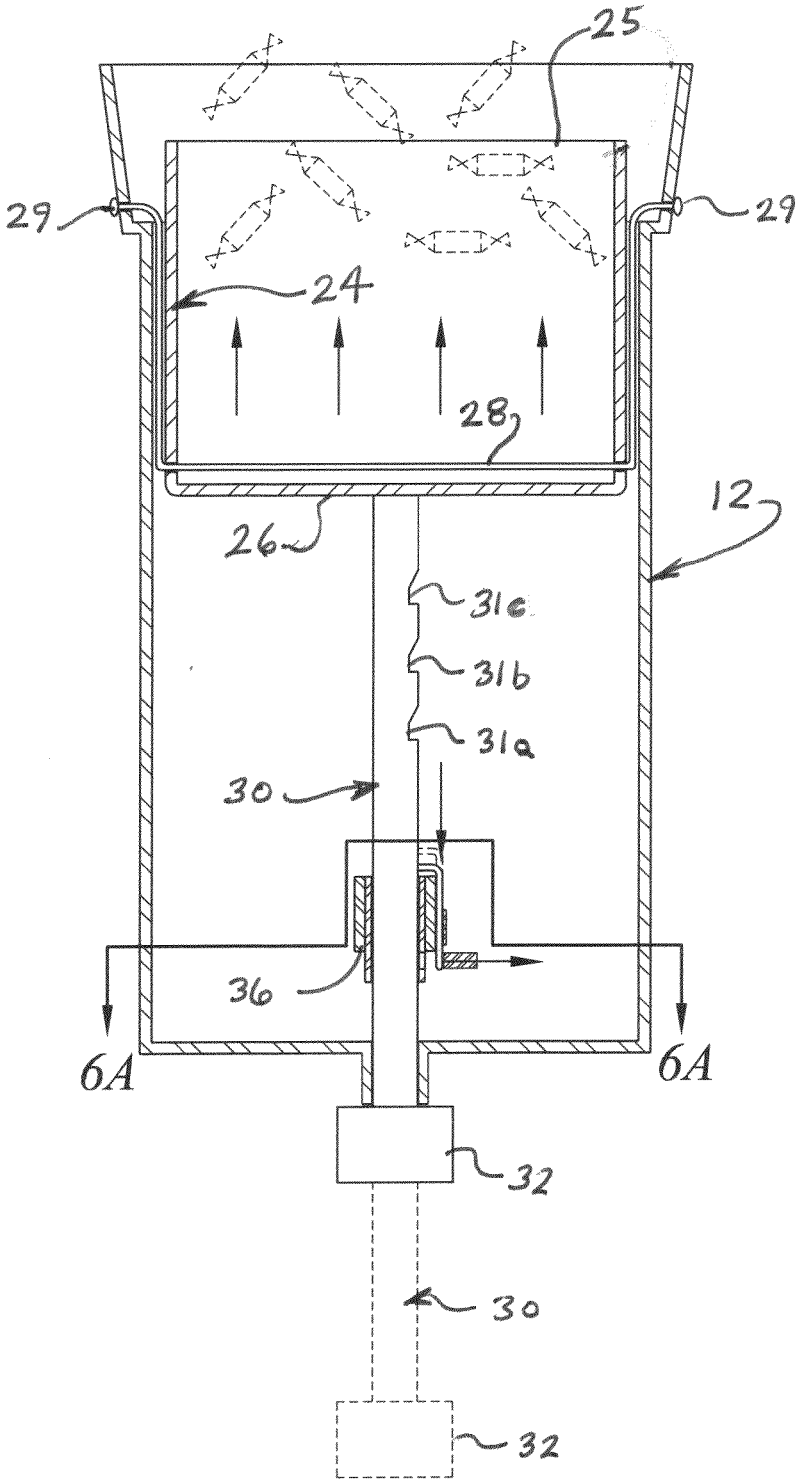
FIG. 4 is an isolated elevational view in partial cross-section showing the candy holding container moving upwardly within the main body in a rapid action in response to a force exerted by the elastomeric bands after actuation and release of the trigger mechanism.

The shaft 30 extends through a sleeve 36 and cross beam 60 to allow for smooth sliding movement and to maintain the shaft on a linear axis. When the shaft 30 is pulled downwardly, from a bottom of the main body, the series of notches are moved in relation to the end of the trigger arm 22. The target 20 on the opposite end of the trigger arm 22 can be adjustably positioned with the use of an adjustment block 40 that pivotally attaches to the end of the trigger arm 22, thereby maintaining the target 20 generally vertical and perpendicular to the floor surface after adjustable angled positioning of the main body. The trigger arm 22 is pivotally movable on pivot pin 42, as seen in FIG. 6A. A spring 48 is attached to both the proximal end 23 of the trigger arm 22 and a stationary pin 46 that is fixed to the beam 60. The spring 48 urges the proximal end 23 of the trigger arm inwardly towards the shaft and into engagement with the notches 31*a*-31*c*. Accordingly, as the shaft 30 is pulled downwardly, the spring 48 will urge the proximal end 23 of the trigger arm 22 into the respective one of the notches 31*a*-31*c* on the shaft 30. The notches are sloped on the upward side to allow the proximal end 23 of the trigger arm 22 to ride out of the notch upon continued downward movement of the shaft when moving from the minimal loaded position to the maximum loaded position. Once the shaft 30 is pulled to the desired loaded position, with the proximal end 23 of the trigger arm 22 received within the respective one of the notches, the shaft 30 can be released wherein the elastomeric bands 28 urge the container 24 and the shaft 30 so that the proximal end 23 of the trigger arm 22 is engaged with the abrupt bottom shoulder of the respective notch 31*a*-31*c*. This defines a loaded position as shown in FIGS. 3 and 5A.

Figure 5A:
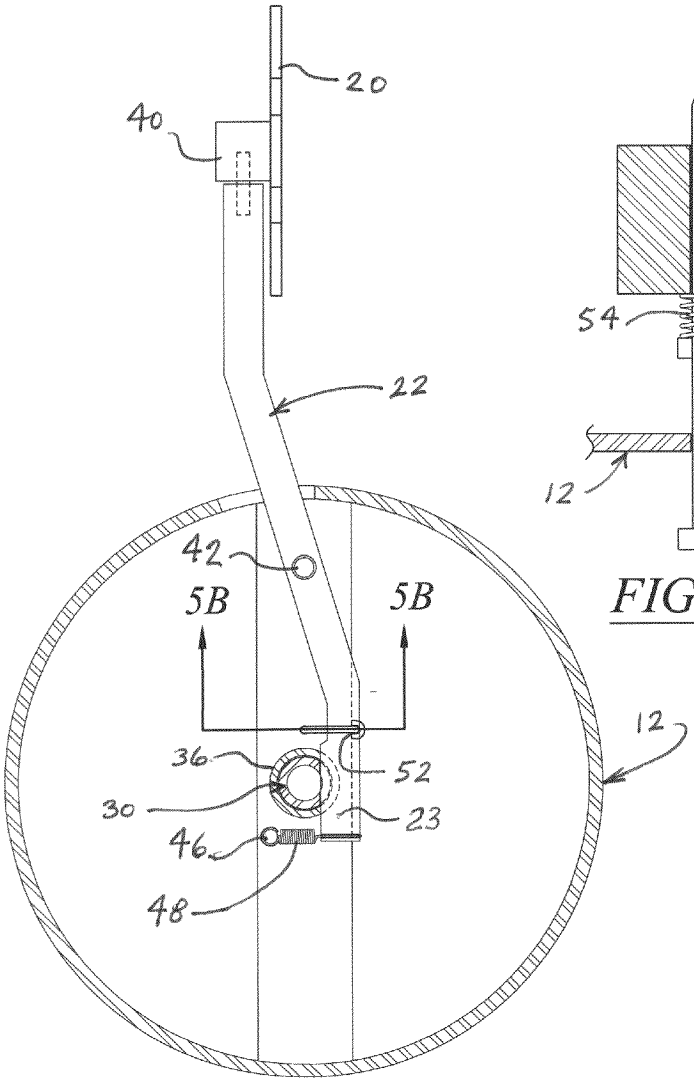
FIG. 5A is an isolated top plan view, in partial cross-section, showing the trigger mechanism in a locked (i.e., loaded) position.
Figure 6A:
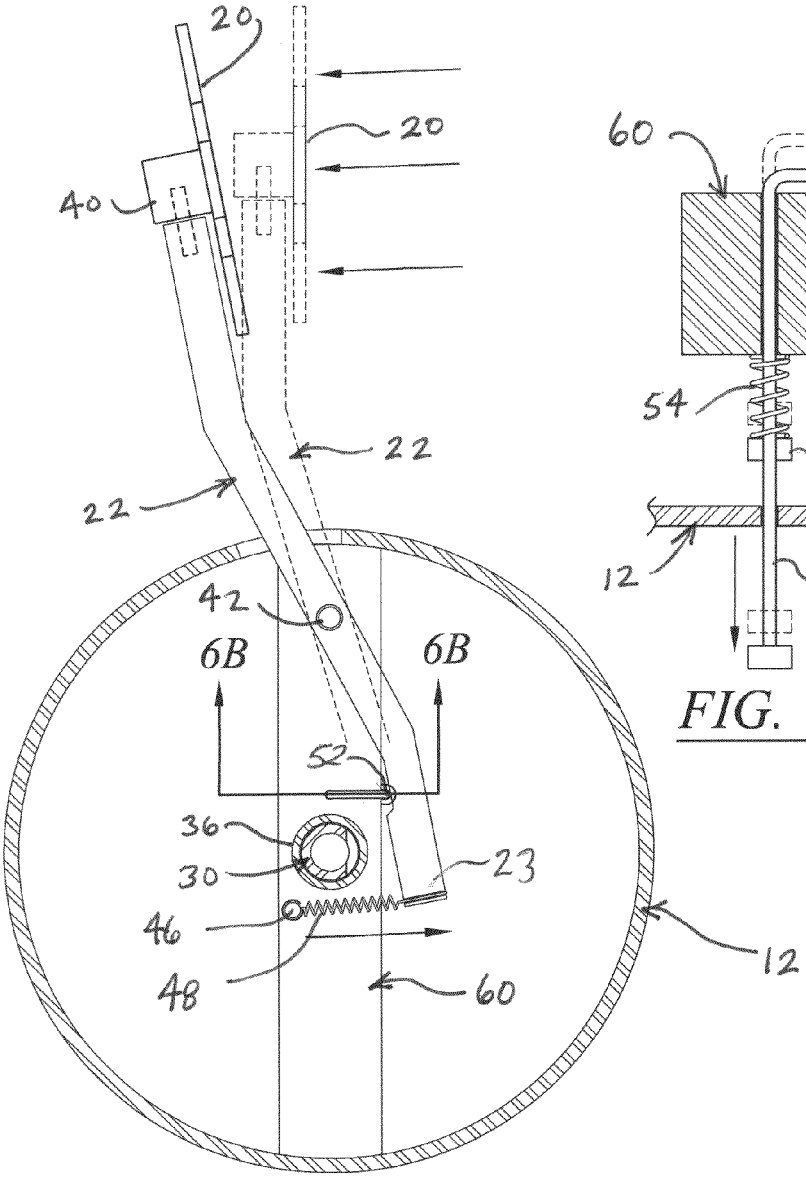
FIG. 6A is a top plan view, in partial cross-section, illustrating movement of the trigger mechanism to the release position in response to an object hitting a target on the end of a trigger arm of the trigger mechanism, thereby actuating release and rapid movement of the candy holding container upwardly, in rapid action, within the main body of the device.

In operation, actuation of the trigger mechanism is achieved by hitting the trigger 20 with an object, such as a ball or bean bag, when the device is in the loaded position (shown in FIG. 5A). Upon impact of the target 20, the trigger arm 22 turns about pivot pin 42, thereby displacing the proximal end 23 of the trigger arm 22 from one of the notches 31*a*-31*c* on the shaft 30 (shown in FIG. 6B). This action frees the tension force of the stretched elastomeric bands 28 being exerted on the container 24, causing the container 24 to immediately accelerate upwardly toward the open top 13. As the opening 25 of the container 24 reaches open top 13, the knob 32 comes into contact with the bottom of the main body 12, forcing the container 24 to come to an immediate stop, which causes the items within the container 24 to be launched outwards of the container 24 and onto the floor for collection.

Figure 5B:
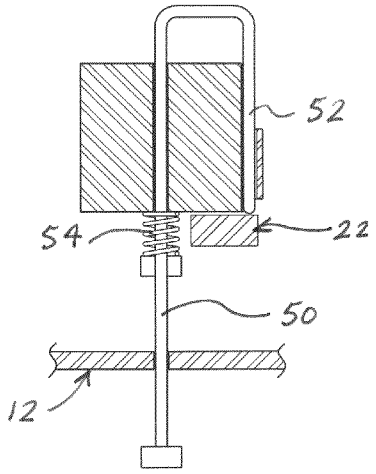
FIG. 5B is an isolated view, in partial cross-section, taken along the plane indicated by the line 5B-5B in FIG. 5A.
Figure 6B:
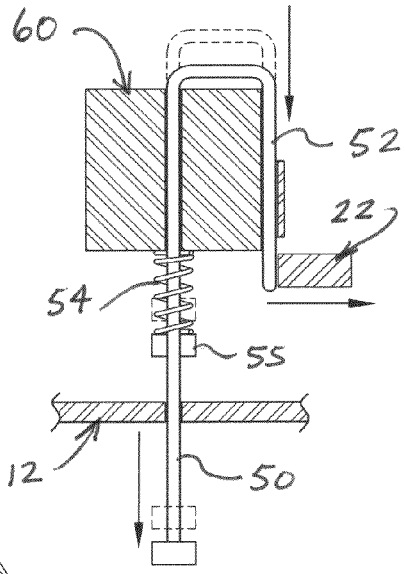
FIG. 6B is an isolated view, in partial cross-section, taken along the plane of the line 6B-6B in FIG. 6A and illustrating a cocking mechanism and movement of a preventer pin into blocking relation of actuation of the trigger mechanism.

Referring specifically to FIGS. 5B and 6B, a cocking mechanism including a reload control rod 50 and a preventer pin 52 is provided for preventing the proximal end 23 of the trigger arm 22 from entering one of the notches 31*b* (if device is originally loaded in notch 31*a*) or 31*c* (if the device is originally loaded in notch 31*a* or 31*b*) immediately after actuation of the trigger mechanism. The reload control rod 50 and preventer pin 52 pass through separate portions of cross-beam 60 and preventer pin 52 is configured to rest against the top of the proximal end 23 of trigger arm 22 when the device 10 is in the loaded position. To operate the cocking mechanism, the reload control rod 50 is pushed upwards, forcing the stopper 55 against the force exerted by spring 54 and urging the reload control rod 50 and preventer pin 52 downwards. After the preventer pin 52 clears the proximal end 23 of the trigger arm 22, spring 48 pulls the proximal end 23 towards the shaft 30 and under the preventer pin 52, thereby loading the trigger mechanism. In operation, upon actuation of the trigger mechanism, the proximal end 23 of the trigger arm 22 is displaced and the preventer pin 52 immediately accelerates downwards into blocking position between the shaft 30 and trigger arm 22, thereby preventing the proximal end 23 of the trigger arm 22 from inadvertently re-entering notch 31*a* or entering one of the notches 31*b* or 31*c*.

Figure 7:
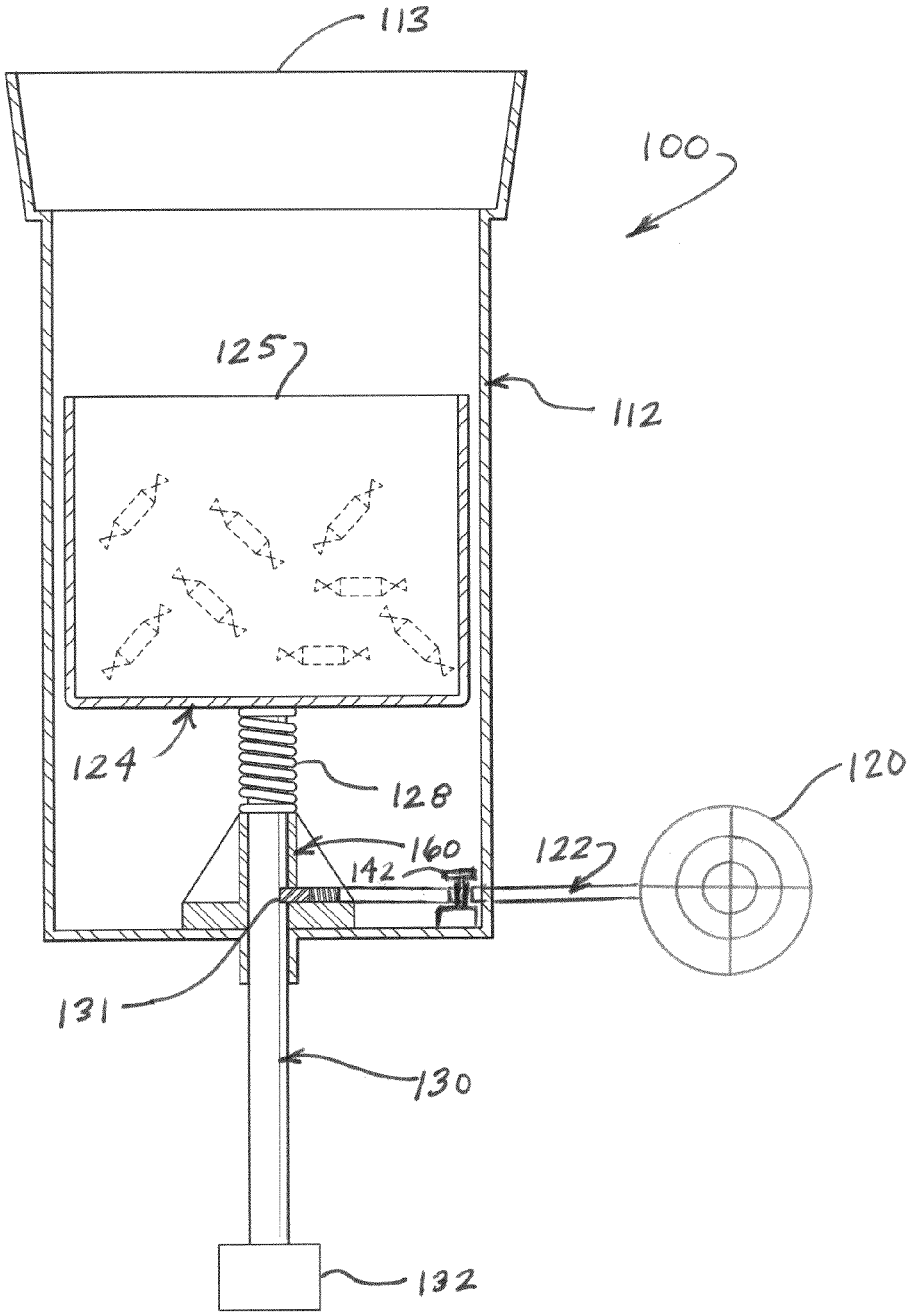
FIG. 7 is an isolated elevational view shown in partial cross-section, illustrating an alternative embodiment of the piñata device of the present invention, wherein the candy holding container is shown in a locked (i.e., loaded) position.
Figure 8:
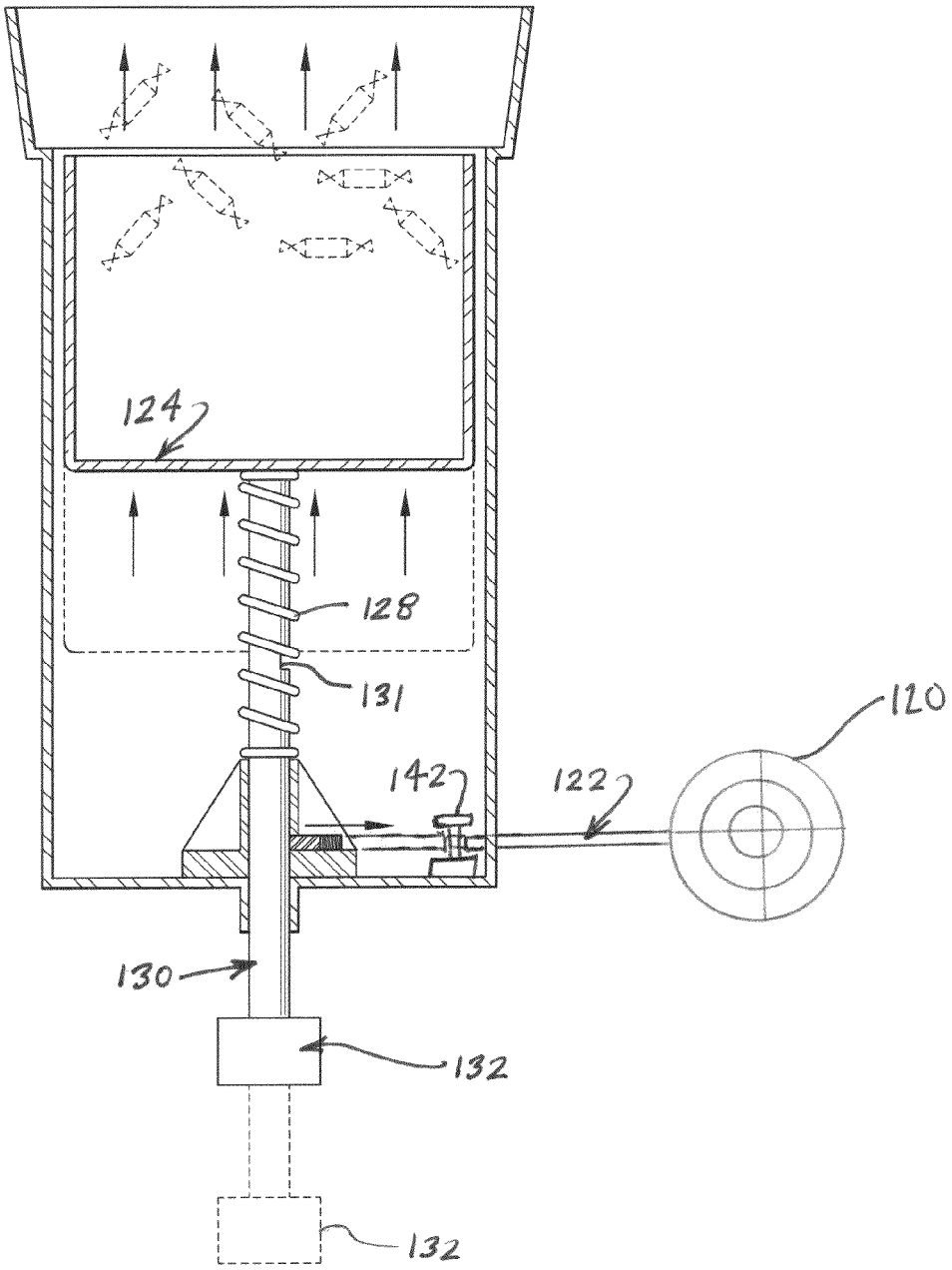
FIG. 8 is an isolated elevational view shown in partial cross-section, illustrating movement of the candy holding container rapidly in an upward direction toward an open top of the main body of the device in response to actuation of a trigger mechanism and release of the candy holding container from the loaded position.

Referring to FIGS. 7 and 8, an alternative embodiment of piñata device 100 is shown which includes a main body 112 that has an open top 113 and a base opposite of the open top 113. A trigger mechanism includes a trigger arm 122 that extends from a lower portion of the main body 112 to a distal end having a target 120 adjustably fitted thereto. An open top container 124 is movably supported within the hollow interior of the main body 112 so that an open top 125 of the container 124 is positioned upwardly towards the open top 113 of the main body. A shaft 130 extends through cross beam 160 on a linear axis. When the shaft 130 is pulled downwardly at knob 132, from a bottom of the main body 112, the end of the trigger arm 122 is locked into notch 131. In this alternative embodiment, the biasing members are in the formed of one or more springs 128 which urges the container 124 upwardly toward the open top 113. The trigger arm 122 is pivotally movable on pivot pin 42, and is displaced from notch 131 when target 120 is hit by an object, such as a ball or bean bag, causing the container 124 to accelerate upwards and launch the items within the container 124 outwards of the container 124 and onto the floor for collection.

Figures 9A, 9B:
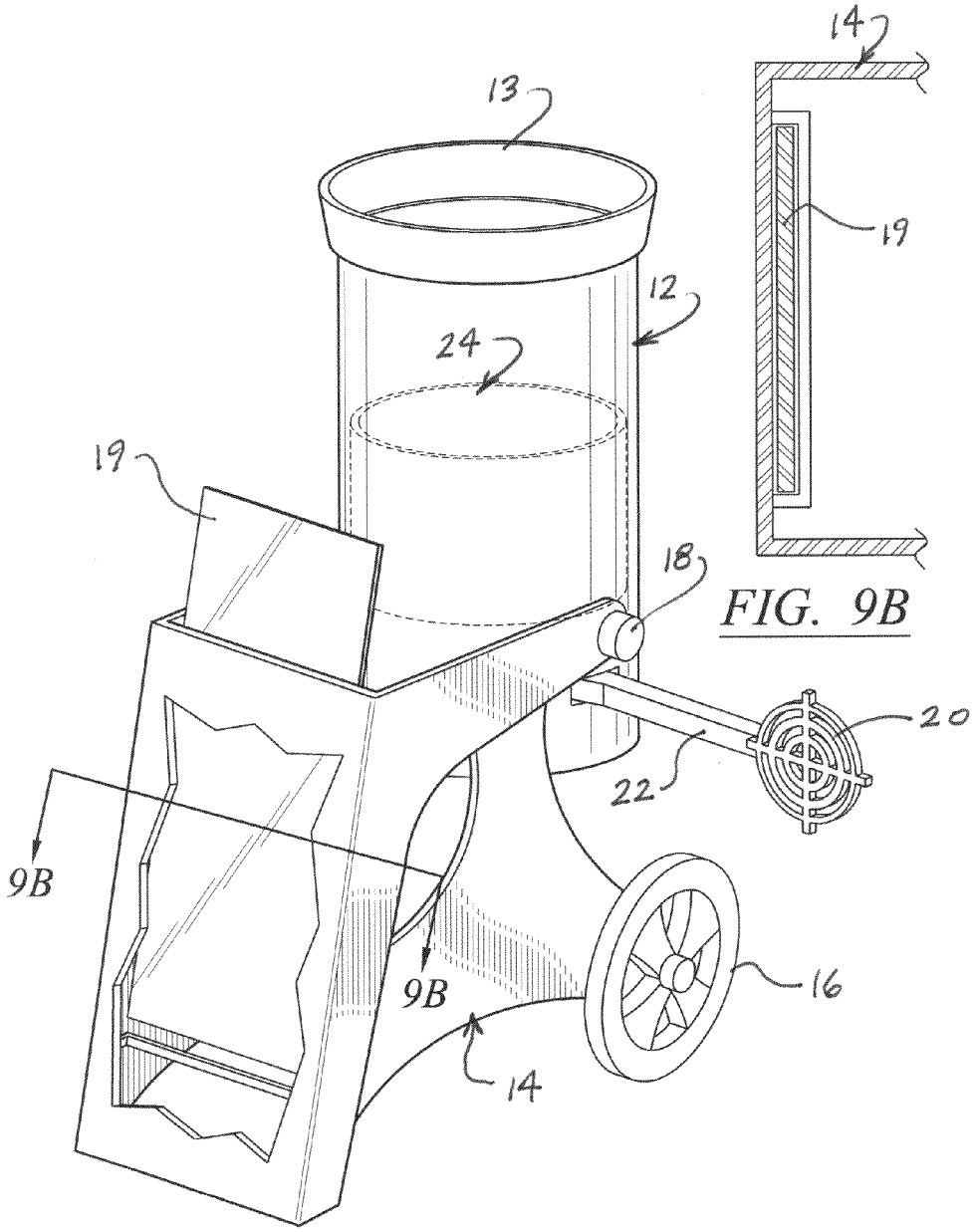
FIG. 9A is a front perspective view of the piñata device of the embodiment of FIG. 1, showing a display panel partially removed from the support base.
FIG. 9B is an isolated cross-sectional view taken along the plane indicted by the line 9B-9B of FIG. 9A.

FIGS. 9A and 9B illustrate the removable display panel or dry erase board 19 that allows for placement of customized messages for a party. The removable display panel or dry erase board 19 may be removed from a holding bracket on the support base 14 for customization of a message and inserted back within the bracket for displaying the customized message.

While the present invention has been shown in accordance with a preferred and practical embodiment, it is recognized that departures from the instant disclosure are fully contemplated within the spirit and scope of the present invention.

What is claimed is:

1. A apparatus for launching items to recipients, said apparatus comprising:

a support base;

a main body attached to said support base, and said main body having an open top;

an open container within said main body for holding the items, and said container being moveable within said main body towards and away from said open top of said main body;

a trigger mechanism comprising:

a trigger arm extending from said main body and having a proximal end within said main body and a distal end at an exterior of said main body, and said trigger arm being pivotally moveable at a pivot mounting between said proximal and distal ends;

a target at the distal end of said trigger arm;

a shaft fixed to the bottom of said container;

a spring connecting said main body to said trigger arm and urging the proximal end of said trigger arm in the direction of said shaft;

a plurality of notches on said shaft, each of said notches being sized and configured to receive at least a portion of the proximal end of said trigger arm;

at least one biasing member securing said main body to said container, and said at least one biasing member being structured and disposed for urging said container upwards towards said open top of said main body when said at least one biasing member is tensioned by moving said container from a normally relaxed position and away from said open top;

whereby pulling downwardly on said shaft until the proximal end of said trigger arm is received within one of said plurality of notches defines a loaded position, wherein the tensioning of said at least one biasing member generates a force for urging said container upwards; and a cocking mechanism comprising:

a reload control rod;

a preventer pin fixed to said reload control rod;

a stopper fixed to said reload control rod;

a spring structured and disposed for urging said reload control rod and said preventer pin downwards when said spring is tensioned by moving said reload control rod from a normally relaxed position; and whereby pushing upwardly on said reload control rod forces said stopper against the tension of said spring until said preventer pin clears the proximal end of said trigger arm and allowing said proximal end of said trigger arm to move towards said shaft; and whereby impacting said target displaces the proximal end of said trigger arm out of one of said plurality of notches, thereby releasing tension of said spring and causing immediate acceleration of said preventer pin in the downwards direction for blocking the proximal end of said trigger arm from re-entering one of said plurality of notches.

2. The apparatus for launching items to recipients as recited in claim 1 further comprising:

a knob at the end of said shaft opposite from said container, and said knob being structured and disposed for contacting the bottom of said main body after said trigger mechanism is released from the loaded position and bringing said container to a stop to launch the items contained therein out from said open top of said main body.

3. The apparatus for launching items to recipients as recited in claim 1 wherein said at least one biasing member is at least one elastomeric band.

* * * * *